US005513704A

United States Patent [19]

Sander

[11] Patent Number: 5,513,704

[45] Date of Patent: May 7, 1996

[54] FLOW BACK FRACTURE STIMULATION SYSTEM

[75] Inventor: Jerome Sander, Elk City, Okla.

[73] Assignee: Servalco, Inc., Elk City, Okla.

[21] Appl. No.: 310,668

[22] Filed: Sep. 22, 1994

[51] Int. Cl.[6] ..... E21B 43/34; B67C 3/00

[52] U.S. Cl. ..... 166/91.1; 166/163; 55/344

[58] Field of Search ..... 166/91, 267, 310, 166/369, 163, 265; 55/342, 343, 344

[56] References Cited

U.S. PATENT DOCUMENTS

| | | | |
|---|---|---|---|
| 856,088 | 6/1907 | Newman | 55/342 X |
| 2,652,130 | 9/1953 | Ferguson | 166/265 X |
| 2,692,051 | 10/1954 | Webb | 166/265 X |
| 3,917,568 | 11/1975 | Klein et al. | 55/342 X |
| 4,224,043 | 9/1980 | Dupre | 55/342 X |
| 4,786,622 | 11/1988 | Walters et al. | 55/342 X |
| 4,880,040 | 11/1989 | Pierson et al. | 166/267 X |
| 4,882,009 | 11/1989 | Santoleri et al. | 166/267 X |
| 5,314,018 | 5/1994 | Cobb | 166/265 |
| 5,368,747 | 11/1994 | Rymal, Jr. et al. | 210/744 |

OTHER PUBLICATIONS

"Composite Catalog", vol. 4, 1986–1987, p. 5733.

*Primary Examiner*—Frank S. Tsay
*Attorney, Agent, or Firm*—Keaty & Keaty

[57] ABSTRACT

The invention relates to fluid flow separators for use with high velocity production fluid flow. The separator has an expansion chamber provided with a flow barrier mounted within the chamber. The barrier is formed from an impact deformable material, such as wood, which allows the solid particles carried by the fluid flow to embed themselves and form a layer against which other solid particles strike without destroying the equipment. A choke assembly is mounted upstream from the barrier and is formed by a main body and a removable choke bean. The bean is threadably engaged within the main body to allow its easy removal once excessive wear is detected. A flexible O-ring seal is made upstream from the threadable engagement and another seal, metal-to-metal, is formed downstream from the engaging threads. A transverse port made in the main body communicates with an annular space formed between an interior wall of the main body and exterior wall of the insert downstream from the metal-to-metal seal. The port allows injection of anti-freeze substance into the flow line.

23 Claims, 3 Drawing Sheets

FLOW BACK FRACTURE STIMULATION SYSTEM

BACKGROUND OF THE INVENTION

This invention relates to the mineral production industry, and more particularly to a system for use during initial status of oil and gas production when the fracture stimulants are allowed to escape from the well bore.

To stimulate fracture production, various agents are often introduced into the well, for example water, sand, nitrogen, foam fracture stimulators, as well as propant agents. Immediately following the beginning of production, these stimulating agents are carried at great velocity and pressure upwardly from the well bore, often eroding its way through metal plates in the production equipment which is mounted to capture the production fluids. It is conventional to employ special personnel to rapidly change the various portions of the system which become damaged after receiving an immediate impact of the propelled stimulants. This personnel must be highly trained in personal safety due to the extreme pressures escaping the well bore in the initial stage of the production. Additionally, there is a continuous threat of the production fluid escaping into the environment, spilling in the area around the production site which would require additional clean-up.

The present invention is designed to eliminate drawbacks associated with the conventional technique and utilize the energy of the high velocity flow by causing it to abruptly diverting its direction.

SUMMARY OF THE INVENTION

It is, therefore, an object of the present invention to provide a flow back system which utilizes the wear and/or cutting action of fracture stimulating agents escaping the production well bore in the initial stages of the production.

It is another object of the present invention to provide a flow back system which is easy to operate and inexpensive to manufacture.

It is a further object of the present invention to provide a pressure choke valve which can be rapidly and easily changed when it wears out due to abrasions caused by the propant elements in the production flow.

These and other objects of the present invention are achieved through a provision of a fluid flow separating apparatus which comprises a primary expansion chamber which is in fluid communication with a production flow line and a secondary expansion chamber in fluid communication with the primary expansion chamber. Mounted within the secondary expansion chamber is a means for abruptly diverting a fluid flow which receives the impact of the fluid flow striking its exposed surface. The surface is formed from an impact deformable material, for example wood, which allows at least a portion of the fluid particles present in the flow to be embedded therein without destructing the surface. The layer which is formed by fluid particles forms a barrier against the subsequent hard particles which strike the surface.

The apparatus further provides for the use of a means for decreasing the velocity of the fluid flow mounted upstream of the flow barrier. The velocity decreasing means are formed as a choke assembly mounted upstream from the primary expansion chamber in fluid communication with the production flow line. The second velocity decreasing means is mounted adjacent an inlet to the secondary expansion chamber, immediately upstream from the flow interrupting barrier.

The choke assembly comprises a main body and a removable insert which is threadably engaged within the interior of the main body. A dual means of sealing the threadable engagement between the main body and the insert are provided. The first such sealing means is a flexible O-ring which is fitted between the insert, or choke bean, and the interior through bore of the main body. The O-ring is positioned upstream from the engaging threads. Another seal is made by metal-to-metal contact by matchingly inclined shoulders formed on the exterior of the choke bean and on the interior of the main body. The metal-to-metal seal is being formed downstream from the engaging threads.

The main body is also provided with a transverse bore which allows injection of an anti-freeze substance into an annular space formed between the choke bean and the interior wall of the main body downstream from the metal-to-metal seal.

The conduits through which the fluid flow passes in the separating apparatus is made of varying diameters for the purpose of breaking the turbulence in the fluid flow and slowing down the flow to further reduce the danger of damage to the downstream equipment. The second velocity decreasing means is formed as a funnel choke with a through longitudinal opening of a diameter smaller than the inlet portion of a spool assembly within which it is mounted. The choke bean and the funnel choke are made easily removable, since their internal bore is subject to the most abrasive impact by the passing solid particles suspended in the fluid flow. The choke bean and the funnel choke are removed once the wear becomes excessive.

A BRIEF DESCRIPTION OF THE DRAWINGS

Reference will now be made to the drawings, wherein like parts are designated by like numerals, and wherein FIG. 1 is a schematic view of the flow back system in accordance with the present invention.

DETAILED DESCRIPTION OF THE PREFERRED EMBODIMENT

Figure 1:
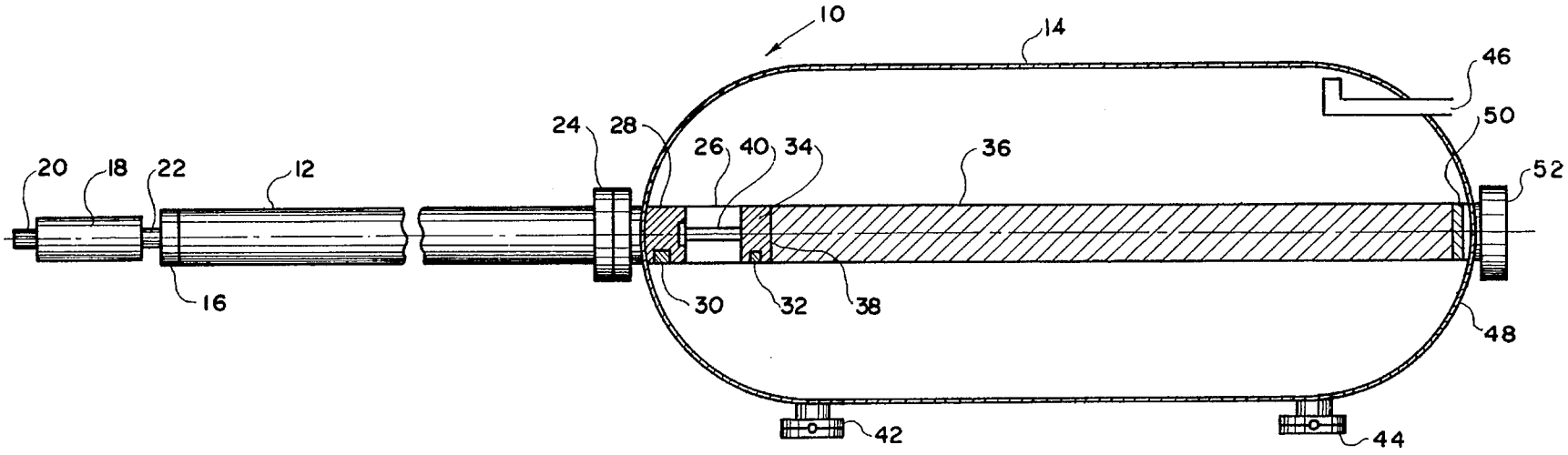

Turning now to the drawings in more detail, FIG. 1 illustrates an overall schematic view of the back flow system in accordance with the present invention. As can be seen in FIG. 1, the system is generally designated by numeral 10 and comprises a primary expansion chamber 12 and a secondary expansion chamber 14. The primary expansion chamber 12 is fluidly connected, through an expansion spool adaptor 16 to a high pressure choke valve spool assembly 18. The choke valve spool assembly 18, in turn, is connected to a production line (not shown) through a flow line 20. The production flow enters the flow line 20 and moves through the choke valve spool assembly 18, wherein the stimulation fluids are directed, under force, through a choke bean 54 mounted within the choke valve spool body and then into the expansion spool adapter 16.

A conventional connector 22 connects the choke valve spool assembly 18 with the expansion adapter 16. The adapter 16, in turn, is fixedly attached, such as by welding, to the inlet end of the primary expansion chamber 12. The chamber 12 which has an outlet end connected to a secondary expansion chamber 14 through a conventional flange connection 24.

As can be seen in FIG. 1, the primary expansion chamber 12 has a greater diameter then the choke valve spool assembly 18 to allow the pressurized fluids escaping from the well bore to expand from the wellhead pressure to atmospheric pressure. The incoming liquids are allowed to fill the primary expansion chamber 12 to a level slightly above the top horizontal edge of the chamber. As a result, the primary expansion chamber 12 is filled with liquid, and incoming fluid is forced through the turbulent flow within the primary expansion chamber 12 towards the secondary expansion chamber 14. This action causes considerable friction and drag on the flow forcing it to slow as it moves from the choke valve assembly 18 towards the secondary expansion chamber 14.

Mounted in co-axial alignment with the primary expansion chamber 12 is a chamber 14 inlet conduit 28. The inlet tube 28 is provided with a pair of flow outlets 30 and 32, the function of which will be described in more detail hereinafter.

An outlet end 26 of the conduit 28 is secured in face-to-face relationship with an elongated bean 36 spanning substantially through the entire longitudinal center of the secondary expansion chamber 14. The bean 36 is made from an impact deformable material, for example a green hardwood log, which allows the hard particles present in the fluid flow to embed themselves in the bean face, or contact surface 38. The diameter of the surface 38 is not less than the diameter of the outlet opening of the choke valve assembly 26, so as to "catch" all solid particles escaping from the assembly 26.

A retaining ring 24 is fitted within the conduit 28 to retain the log 36 in place. Once the flow encounters the barrier formed by the face 38, it is abruptly stopped and its direction diverted, thereby further slowing the incoming fluids. The propants present within the fluid become embedded into the log face 38 to form a solid layer of propants in a relatively short period of time. Once the layer of propants has been established, the forward flowing fluids carrying propants are severely restrained in the speed of movement. As a result, the wear on the impact surface 38 and the cutting effect of the abrasive particles are minimized.

Additional slowing down of the flow is achieved by varying diameters of the conduits through which the flow moves. The relatively large diameter of the primary expansion chamber 12 is reduced when the flow reaches the funnel choke 40 positioned within a spool assembly 25, and subsequently through an enlarged diameter of the outlet 26. The variation in the diameters of the conduit through which the flow passes causes the heavy particles to move from a narrow flow to a wider flow pattern, thereby making it easier to slow down the turbulence of the flow and stop progression of the particles.

Since the flow terminates at the face 38 of the bean 36, the major portion of the produced fluids, natural gas, and propants will be forced to exit the inlet pipe 28 through the openings 30 and 32 formed in that side of the inlet tube which faces downwardly. The produced flow enters the interior and the secondary production chamber 14 allowing the natural gas to expand and move to the upper part of the chamber 14, and allowing the heavy liquids to move, under gravity, downwardly to the bottom of the chamber housing 14. The liquids, along with the propants and other heavy particles are discharged by manually adjusted dump valves 42 and 44, while the natural gas is allowed to exit the chamber 14 through a gas outlet 46 located in the upper part of the chamber 14. The natural gas can be vented into the atmosphere or flared at a safe distance from the flow back system 10.

The manually adjusted valves 42 and 44 are designed to maintain the desired fluid levels in the secondary expansion chamber 14 to allow better separation of gas and liquids of the production flow. The opposite end of the bean 36 is securely attached to an end wall 48 of the chamber 14 through the use of back-up safety plates 50 and an end flange 52.

Figure 3:
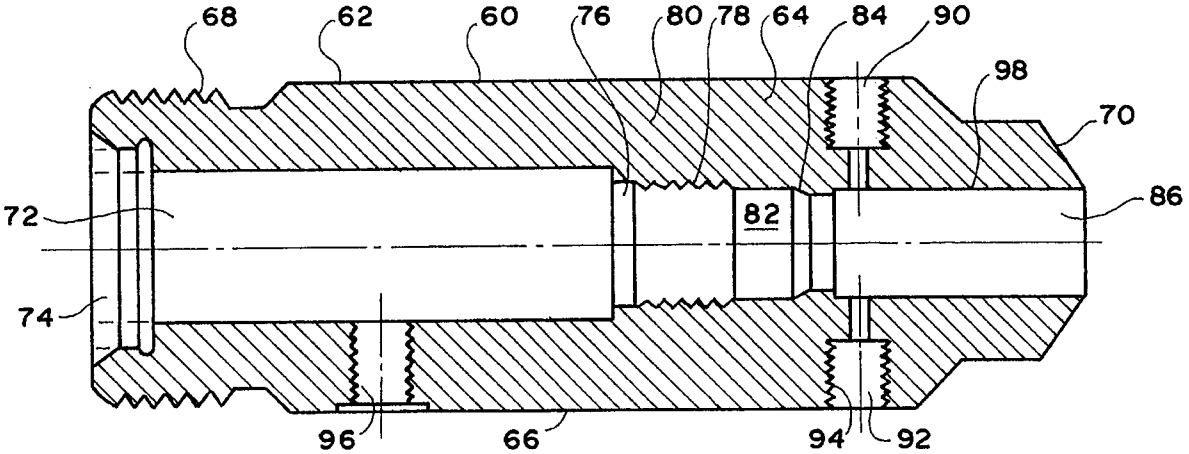
FIG. 3 is a longitudinal section of the choke assembly body utilized in the system of the present invention.
Figure 4:
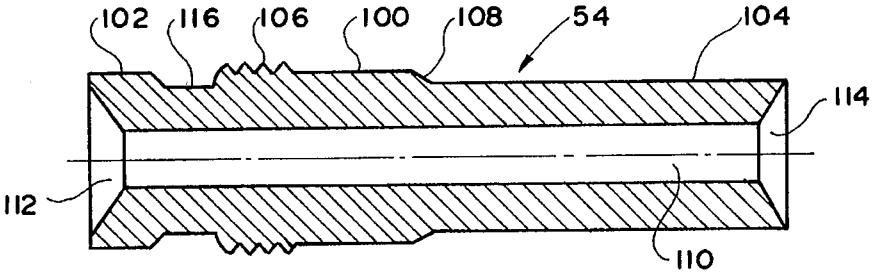
FIG. 4 is a sectional detail view of a choke valve insert, or choke bean adapted to be used with the high pressure choke valve assembly in the system of the present invention

Turning now to FIGS. 3 and 4, the choke valve spool assembly is shown to comprise an elongated body 60 having an upstream portion 62, a downstream portion 64, and a middle portion 66. The upstream portion 62 is formed with external threads 68 which are adapted to engage an inlet end of a flow line 20. The opposite end of the body 60 is formed with a beveled edge 70 adapted for butt welding to a standard connector, for example a wing half union 71.

A central opening 72 extends through the entire length of the body 60 and contains several chambers of variable diameters. The upstream end of the opening 72 has an outwardly flaring portion 74 which gives access to an O-ring groove 76 formed in the middle portion of the body 60. A port 80 of the body 60 is internally threaded, such as at 78. A reduced diameter opening 82 is formed downstream from the threaded portion 80, the part 82 being formed with an inwardly inclined shoulder 84 which further reduces the restricted opening 82 before it reaches an enlarged diameter chamber 86 formed in the downstream portion 64 of the body 60.

A chemical injection port 90 is counter-bored in the portion 64, the port 90 communicating with the chamber 86. A second counter-bore 92 is formed in the portion 64, the counter bore 92 serving as a pressure relief port. The bore 92 is formed with internal threads 94, in at least a portion thereof, to allow a standard pressure relief element to be positioned therein. A third bore 96 is formed upstream from a choke bean 54 to allow pressure relief when the choke bean 54 needs to be changed.

Figure 5:
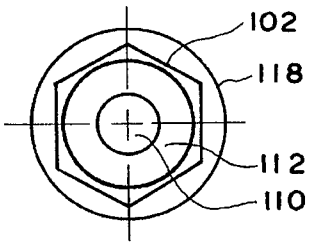
FIG. 5 is an end view of the choke bean showing a head of the insert and an O-ring.

The choke bean 54 is adapted for positioning inside the central opening 72 of the choke valve spool assembly 18. The choke bean 54, as seen in FIG. 4, comprises an elongated bean body 100 having a first end 102, and a second end 104. The first end 102 is formed hexagonal in shape, as shown in FIG. 5, to allow easy withdrawal of the choke bean from the spool assembly when the bean 54 is changed due to excessive wear. When the choke bean 54 is positioned within the body 60, the hexagonal end 102 extends within the chamber 74 in the upstream portion 62 of the body 60.

Formed a distance from the first end 102 is an externally threaded part 106 which is adapted to fit and engage the internal threads 78 of the portion 80. A beveled shoulder 108 is formed between the threads 106 and the second end 104. The beveled shoulder 108 matches the inner beveled shoulder 84 in the body 60 and forms a metal-to-metal seal downstream from the threaded engagement between the choke bean 54 and the body 60. The length of the bean 54 is generally greater than the length of the body 60, so that the end 104 extends outwardly from the downstream end of the body 60, directly into an expansion spool adapter 16.

The external diameter of the choke bean 54 downstream from the shoulder 108 is smaller than the internal diameter of the chamber 86. As a result, an annular space 98 is formed between the part 104 of the choke bean body 60 and the metal-to-metal shoulder seal. The annular space 98 allows to inject the chemicals through the port 90 into the opening 72 and transmit the chemicals directly into the flow line of the primary expansion chamber 12. Generally, the chemicals are injected to prevent freezing in the flow line and to prevent icing.

The flow of production fluid passes through the axial opening 110 extending through the entire body 100 of the choke bean 54. The opening 110 has an inlet portion 112 and an outlet portion 114. Both portions 112 and 114 flare outwardly, and the fluid flow is forced to move through a reduced diameter of the opening 110 after entering the choke bean through the end 112. The flow is further allowed to expand its path when exiting the body 100 from the outlet end 114.

An O-ring groove 116 is formed on the exterior of the choke bean body 100 between the hexagonal inlet end 102 and the threaded portion 106. The groove 116 is adapted to receive an O-ring 118 in such a manner that it tightly fits within the internal groove 76 of the choke valve spool body 60. The flexible means of sealing the threaded connection 106 and 78 provides an upstream protection of the threaded connection. The O-ring 118 provides stabilization upstream from the threaded connection, while the metal-to-metal contact protects the threads from the downstream flow. This arrangement constitutes an improvement over conventional choke assemblies which provide only metal-to-metal contact both upstream and downstream from the threads. Provision of the chemical injection port downstream from the threaded connection allows the flow of chemicals to remove all ice and allow the chemicals to escape passage through compression. The chemicals will not freeze and will be "pulled" into the flow line from the annular space 98 due to the high velocity of flow in the primary expansion chamber 12.

Figure 2:
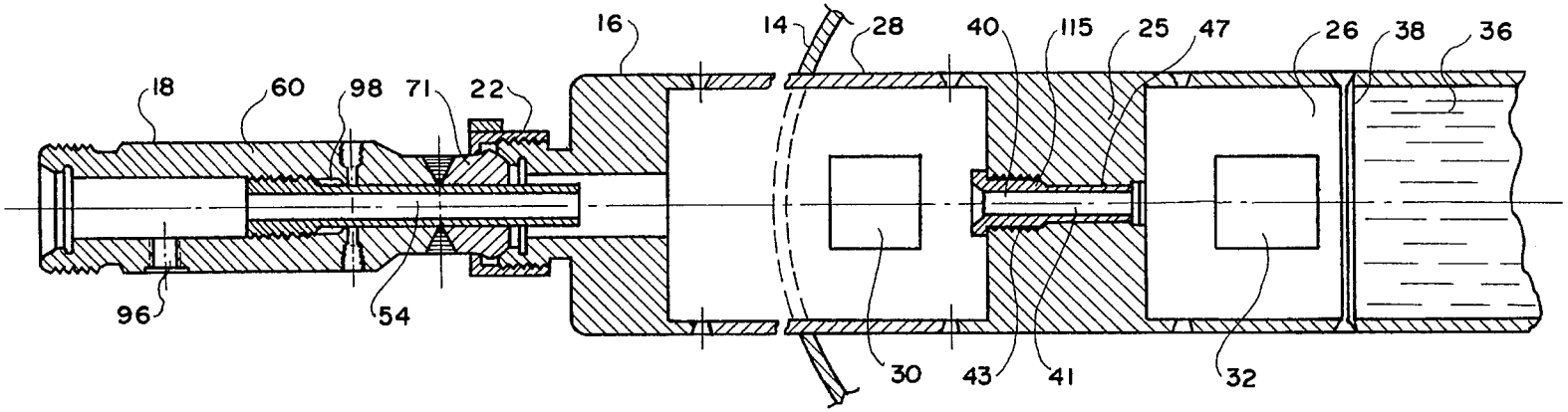
FIG. 2 is a sectional detail view showing the choke assembly and the funnel choke.
Figure 6:
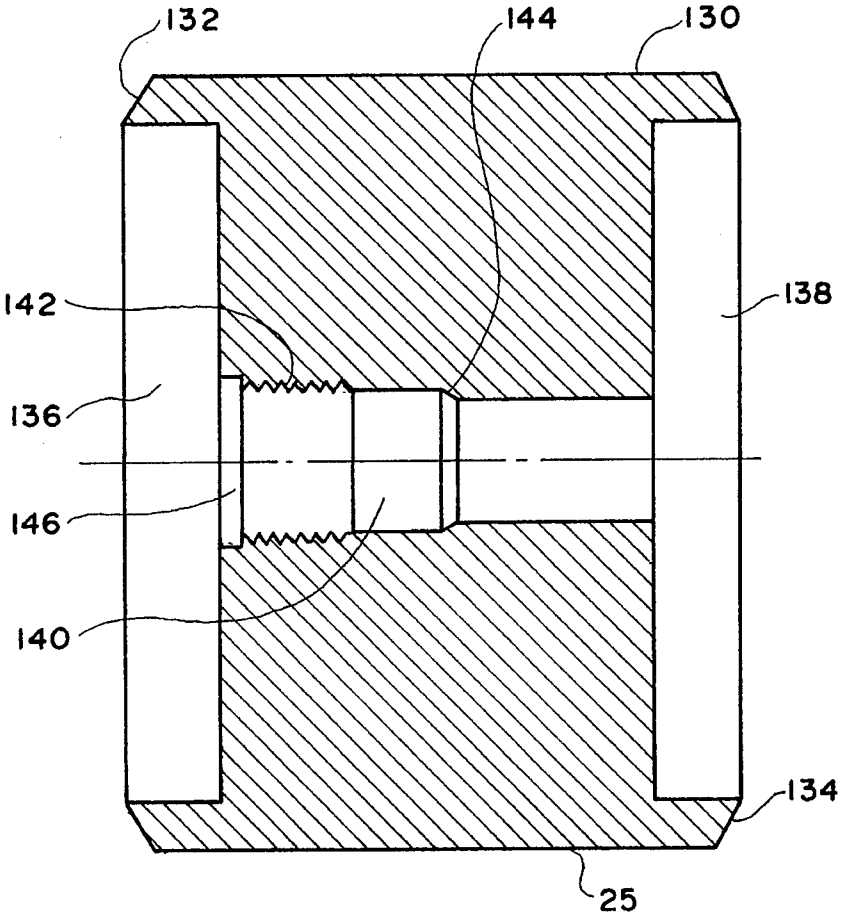
FIG. 6 is a sectional view of an extension spool adaptor utilized in the system in accordance with the present invention.

FIG. 6 illustrates an expansion spool adapter 16 which has a reduced diameter externally threaded part 120 and an enlarged diameter cylindrical part 122 unitarily connected to the part 120. The downstream end of the part 122 is formed with beveled edges 124 for connection to the primary expansion chamber conduit as shown in FIG. 2. The flow exiting the choke bean 54 enters the central chamber 126 formed in the adapter 126 and exits through a preferably enlarged diameter outlet opening 128 in the portion 122.

Figure 7:
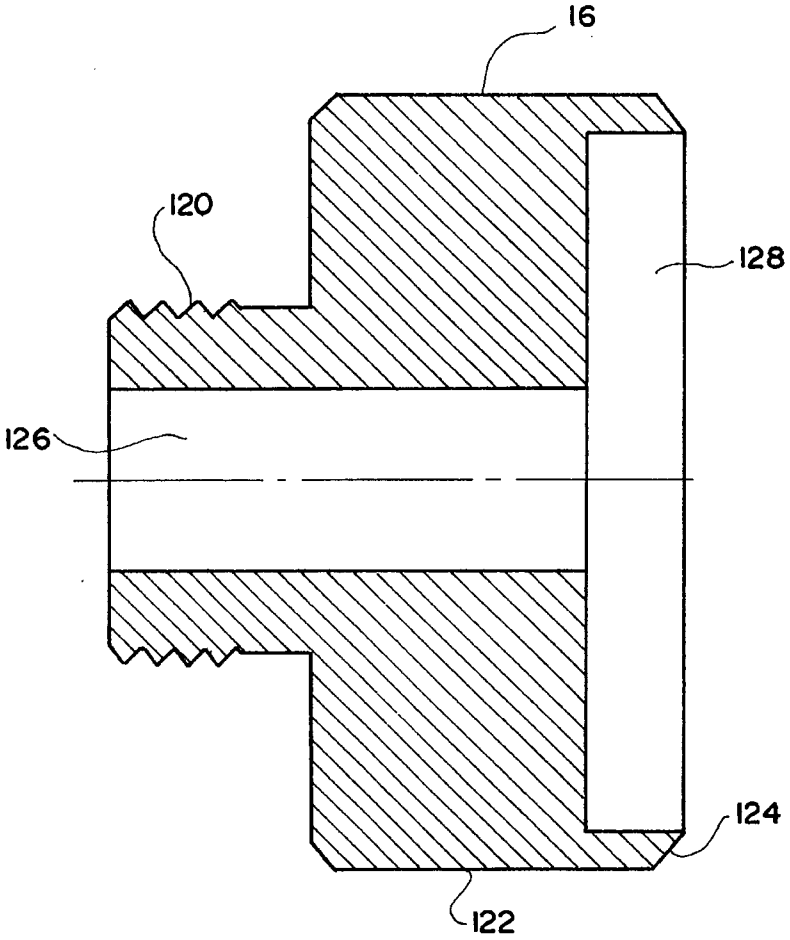
FIG. 7 is a sectional view of a connecting spool assembly member utilized in the system of the present invention.

Shown in FIG. 7 is spool assembly 25 which is positioned immediately at the inlet of the secondary expansion chamber 14. The spool assembly 25 has a generally cylindrical body 130 having beveled edges 132 and 134 formed on its opposite ends. Both ends are provided with openings 136 and 138 which have a diameter approximating the external diameter of the body 130. The openings 136 and 138 are connected by a central bore 140 which is adapted to receive a funnel choke 40 therein. The funnel choke 40 is somewhat similar to the choke bean 54 shown in FIGS. 2 and 3 that is positioned within the assembly 18 but differs in the diameter of the central opening 41 and a conical upstream portion 43. The bore 140 is provided with internal threads 142 which match the external threads 45 on the funnel choke body 47, while the beveled internal shoulder 144 matches the beveled shoulder on the exterior of the bean body 47. An O-ring groove 146 is formed upstream from the threads 142 to receive the O-ring 118 which is mounted on the exterior of the body 47, within the groove 116.

The difference in conduit diameters through which the flow of production fluid passes from the choke valve spool assembly 18, through the primary expansion chamber 12, funnel choke 40 and the outlet 26 causes the heavy particles to fling out of a narrow flow into a wider flow pattern, thereby making it easier to slow down and stop the turbulence of the flow. The provision of the hardwood log 36 in the secondary expansion chamber minimizes the damage caused by the propants to the downstream equipment, exposing only the easily removable and replaceable log 36 to possible damage.

The positioning of the choke bean 54 in an easily removable location allows to change damaged or worn out bean 54 by hand at any time such change becomes necessary.

Many changes and modifications can be made within the design of the present invention without departing from the spirit thereof. I, therefore, pray that my rights to the present invention be limited only by the scope of the appended claims.

I claim:

1. A flow separating apparatus, comprising:

a primary expansion chamber mounted in fluid communication with a fluid production line;

a secondary expansion chamber adapted to receive the fluid flow from the primary expansion chamber; and a means mounted within said secondary expansion chamber for abruptly diverting direction of the fluid flow, said means comprising an impact deformable surface into which at least a portion of solid particles carried by the fluid flow becomes imbedded as the flow strikes the surface.

2. The apparatus of claim 1, wherein said surface is formed from wood.

3. The apparatus of claim 1, wherein said secondary expansion chamber comprises means for removing the fluid from the secondary chamber.

4. The apparatus of claim 3, wherein said means for removing the fluid comprises at least one dump valve mounted on a bottom of the secondary expansion chamber.

5. A flow separating apparatus, comprising:

a primary expansion chamber mounted in fluid communication with the fluid production line;

a secondary expansion chamber adapted to receive the fluid flow from the primary expansion chamber;

a means mounted within said secondary expansion chamber for abruptly diverting direction of the fluid flow; and a means for decreasing velocity of the fluid flow mounted upstream of said means for diverting direction of the fluid flow, wherein said means for decreasing the velocity comprises a choke assembly mounted upstream of said primary expansion chamber and a reduced diameter choke member mounted adjacent an inlet of said secondary expansion chamber.

6. The apparatus of claim 5, wherein said choke assembly comprises a main body and a removable insert, said insert having a restricted diameter through bore.

7. The apparatus of claim 6, wherein said main body comprises an upstream portion and an downstream portion, means for connecting the upstream portion to a production flow conduit, means for securing said insert in the bore of said main body, and a means for sealing the upstream portion from the downstream portion.

8. The apparatus of claim 7, wherein said connecting means comprises external threads formed on the upstream portion of the main body.

9. The apparatus of claim 7, wherein said means for securing the insert comprises threads formed on an interior wall of the main body that defines said through bore.

10. The apparatus of claim 9, wherein said sealing means comprises a resilient flexible seal fitted between an exterior wall of said insert and the interior wall of said main body, said flexible seal being mounted upstream from said internal threads.

11. The apparatus of claim 10, wherein said sealing means further comprises an inclined shoulder formed on the exterior wall of the insert and a matchingly inclined shoulder formed on the interior wall of the main body downstream from said internal threads, said insert shoulder and the main body shoulder contacting each other when the insert is threadably engaged with the main body.

12. The apparatus of claim 11, wherein an annular space is formed between an exterior wall of the insert and the interior wall of the main body downstream from said inclined shoulders.

13. The apparatus of claim 12, wherein said main body is provided with a transverse port to allow injection of an anti-freeze substance into said annular space.

14. The apparatus of claim 5, wherein said reduced diameter choke member comprises a hollow body having a through opening, said opening being provided with an enlarged diameter inlet portion and a reduced diameter outlet portion so as to funnel the fluid flow while it moves through the choke member.

15. A flow separating apparatus, comprising:

a primary expansion chamber mounted in fluid communication with a fluid production line;

a secondary expansion chamber adapted to receive the fluid flow from the primary expansion chamber;

a means mounted within said secondary expansion chamber for abruptly diverting direction of the fluid flow, said means for diverting the fluid flow comprising an impact deformable surface into which at least a portion of solid particles carried by the fluid flow becomes embedded as the flow strikes the surface; and a means for decreasing velocity of the fluid flow mounted upstream of said means for diverting the flow.

16. The apparatus of claim 15, wherein said surface is formed from wood.

17. The apparatus of claim 15, wherein said means for decreasing the fluid flow comprises a choke assembly mounted upstream of said primary expansion chamber and a funnel choke member mounted adjacent an inlet of said secondary expansion chamber, said choke assembly comprising a main body and a removable insert, said insert having a restricted diameter through bore.

18. The apparatus of claim 17, wherein said main body comprises an upstream portion and a downstream portion, means for connecting the upstream portion to a production flow conduit, said connecting means comprising external threads formed on the upstream portion of the main body, said main body further comprising a means for securing said insert in the bore of the main body and a means for sealing the upstream portion from the downstream portion.

19. The apparatus of claim 18, wherein said means for securing the insert comprises threads formed in an interior wall of the main body that defines said through bore.

20. The apparatus of claim 19 wherein said sealing means comprises an O-ring fitted between an exterior wall of said insert and the interior wall of the main body, said O-ring being mounted upstream from the internal threads.

21. The apparatus of claim 20, wherein said sealing means further comprises an inclined shoulder formed on the exterior wall of the insert and a matchingly inclined shoulder formed on the interior wall of the main body downstream from said internal threads, said insert shoulder and the main body shoulder contacting each other when the insert is threadably engaged with the main body.

22. The apparatus of claim 21, wherein an annular space is formed between the exterior wall of the insert and the interior wall of the main body downstream from said inclined shoulder, and wherein said main body is provided with a transverse port to allow injection of an anti-freeze substance into said annular space.

23. The apparatus of claim 17, wherein said funnel choke member comprises a hollow body having a through longitudinal opening, said opening being generally funnel-shaped to cause the velocity of the fluid flow to decrease as the fluid flow moves through the opening.

* * * * *